US009950897B2

(12) United States Patent
Kumar et al.

(10) Patent No.: US 9,950,897 B2
(45) Date of Patent: Apr. 24, 2018

(54) APPARATUS FOR HOLDING A CARD

(71) Applicant: Wipro Limited, Bangalore (IN)

(72) Inventors: Vijay Kumar, Bangalore (IN); Balaji Sunil Kumar, Bangalore (IN); Shagun Rai, Allahabad (IN)

(73) Assignee: Wipro Limited, Bangalore (IN)

( * ) Notice: Subject to any disclaimer, the term of this patent is extended or adjusted under 35 U.S.C. 154(b) by 87 days.

(21) Appl. No.: 15/069,297

(22) Filed: Mar. 14, 2016

(65) Prior Publication Data

US 2017/0217723 A1 Aug. 3, 2017

(30) Foreign Application Priority Data

Jan. 28, 2016 (IN) ..... 201641003121

(51) Int. Cl.
*B65H 75/48* (2006.01)

(52) U.S. Cl.
CPC ..... *B65H 75/48* (2013.01)

(58) Field of Classification Search
CPC .... A44C 3/001; B65H 75/4484; B65H 75/48; D01H 13/1633; G07C 9/00007; G07C 9/00111; G07C 9/00119; G09F 1/103; G09F 2027/001; G09F 3/207
See application file for complete search history.

(56) References Cited

U.S. PATENT DOCUMENTS 4,517,758 A * 5/1985 Thompson ..... G09F 19/02 136/291
7,071,820 B2 * 7/2006 Callaway ..... G08B 21/02 340/506
9,213,220 B2 * 12/2015 Fowler ..... G03B 17/56
9,235,742 B1 * 1/2016 Qaddoura ..... G06T 3/60
2003/0122782 A1 * 7/2003 Yamaguchi ..... B60R 11/0235 345/158
2005/0011981 A1 1/2005 Baumgarten
2011/0304472 A1 * 12/2011 Chou ..... H04N 13/0479 340/689
2012/0104287 A1 * 5/2012 Derks ..... G09F 3/207 250/493.1
2012/0146906 A1 * 6/2012 Song ..... G06Q 30/02 345/158
2013/0258129 A1 * 10/2013 Burns ..... H04N 5/232 348/222.1
2014/0043475 A1 * 2/2014 Lee ..... G09F 15/00 348/143

(Continued)

*Primary Examiner* — Charles A Fox
*Assistant Examiner* — Christopher E Veraa
(74) *Attorney, Agent, or Firm* — LeClairRyan PLLC

(57) ABSTRACT

The present disclosure relates to a holding apparatus for holding a card. The holding apparatus comprises at least two proximity sensors, a control unit and a motor. Each of the at least two proximity sensors are configured to determine orientation of the card when the card is present in the holding apparatus. The control unit is configured to determine status of each of the at least two proximity sensors in order to determine a position of the holding apparatus. The status of the at least two proximity sensors is at least one of open and close. The control unit is further configured to transmit a control signal to the motor based on the determined status. The motor rotates the card upon receiving the control signal, thereby orienting the card with respect to a viewer of the card.

20 Claims, 8 Drawing Sheets

(56) References Cited

U.S. PATENT DOCUMENTS

| | | | | |
|---|---|---|---|---|
| 2014/0232632 | A1 | 8/2014 | Hodges et al. | |
| 2015/0109475 | A1* | 4/2015 | Matilainen | H04M 1/0264 348/222.1 |
| 2015/0288857 | A1* | 10/2015 | Fay | H04N 5/2251 348/36 |
| 2016/0250754 | A1* | 9/2016 | Chang | B25J 9/1664 700/259 |
| 2016/0320525 | A1* | 11/2016 | Brigham | G06Q 30/02 |
| 2017/0064926 | A1* | 3/2017 | Gutierrez | A01K 15/025 |
| 2017/0155805 | A1* | 6/2017 | Son | H04N 5/2251 |

* cited by examiner

APPARATUS FOR HOLDING A CARD

This application claims the benefit of Indian Patent Application Serial No. 201641003121 filed Jan. 28, 2016, which is hereby incorporated by reference in its entirety.

TECHNICAL FIELD

The present subject matter is related, in general to an electromechanical device, and more particularly, but not exclusively to a holding apparatus for holding a card and a method for automatically rotating the card using the holding apparatus when the card is not displayed properly to a viewer of the card

BACKGROUND

Generally, in an organization, as per its policy, it is mandatory for all the employees of the organization to possess and carry Identity cards (IDs) that are authorized by the organization. IDs are a conclusive proof that the person carrying the ID card belongs to a particular organization, and all that the security personnel need to do is to check the ID and then let the person inside the organization's premises. ID cards are also a way of keeping track of an employee's in and out timings. In certain scenarios, the employee may have to display the front side of the ID to the security personnel at the premise or the respective department's door in the organization to authenticate themselves for an entry.

However, many a times the employee might not be wearing the ID card properly i.e., the front side of the ID card may not be displayed correctly to the security personnel due to several factors, such as, wind spinning the card or when the ID card is kept in the bag/pocket/hand of the employee. Hence, there is always a chance that the ID is displayed incorrectly. In such a scenario, the employee has to manually turn the ID card in order to display it correctly to the security personnel. But, for an employee who needs to clear regular security checkpoints, it becomes an onerous activity to manually rotate the ID card each time passing through the checkpoints. Therefore, there is a need for automatically rotating the ID cards when the ID cards are not displayed correctly to the security personnel.

SUMMARY

Disclosed herein is a holding apparatus for holding a card. The holding apparatus determines whether the held card is displayed correctly to a viewer or not. If the card is not displayed correctly to the viewer, the holding apparatus shall auto rotate the card with the help of one or more components in the holding apparatus.

Accordingly, the present disclosure relates to a holding apparatus for holding a card. The holding apparatus comprises at least two proximity sensors, a control unit and a motor. Each of the at least two proximity sensors are configured to determine orientation of the card when the card is present in the holding apparatus. The control unit is configured to determine status of each of the at least two proximity sensors in order to determine a position of the holding apparatus. The status of the at least two proximity sensors is at least one of open and close. The control unit is further configured to transmit a control signal to the motor based on the determined status. The motor rotates the card upon receiving the control signal, thereby orienting the card with respect to a viewer of the card.

Further, the present disclosure relates to a method of rotating a card using a holding apparatus. The method comprises determining orientation of the card when the card is present in the holding apparatus using at least two proximity sensors in the holding apparatus. Further, a control unit configured in the holding apparatus determines status of each of the at least two proximity sensors in order to determine the position of the holding apparatus. The control unit further transmits a control signal to a motor based on the determined status. The status of the at least two proximity sensors is at least one of open and close. The motor, upon receiving the control signal from the control unit, rotates the card in the holding apparatus, thereby orienting the card with respect to a viewer of the card.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The accompanying drawings, which are incorporated in and constitute a part of this disclosure, illustrate exemplary embodiments and, together with the description, serve to explain the disclosed principles. In the figures, the left-most digit(s) of a reference number identifies the figure in which the reference number first appears. The same numbers are used throughout the figures to reference like features and components. Some embodiments of system and/or methods in accordance with embodiments of the present subject matter are now described, by way of example only, and with reference to the accompanying figures, in which.

Figure 1:
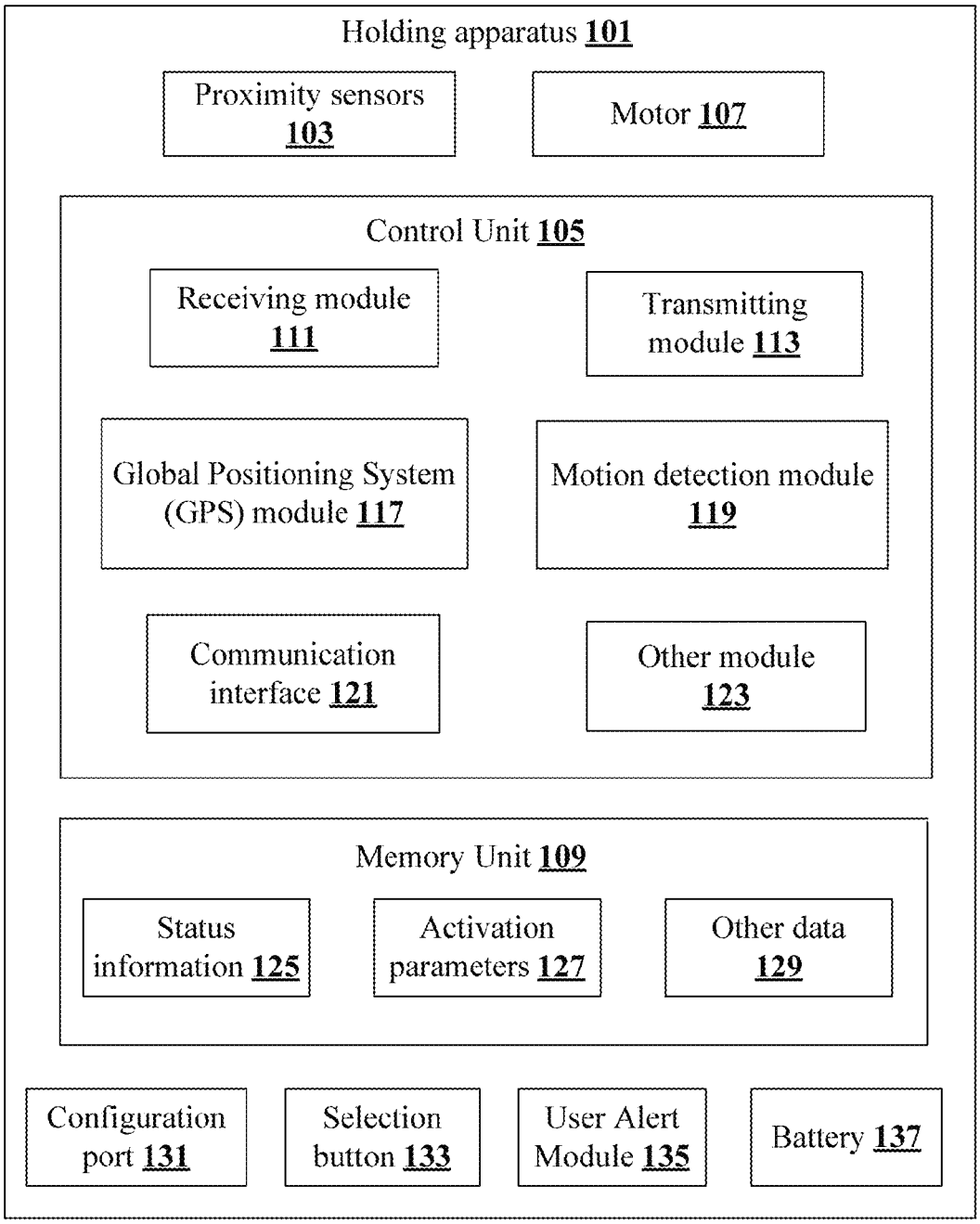
FIG. 1 shows a detailed block diagram illustrating a holding apparatus for holding a card in accordance with some embodiments of the present disclosure.

It should be appreciated by those skilled in the art that any block diagrams herein represent conceptual views of illustrative systems embodying the principles of the present subject matter. Similarly, it will be appreciated that any flow charts, flow diagrams, state transition diagrams, pseudo code, and the like represent various processes which may be substantially represented in computer readable medium and executed by a computer or processor, whether or not such computer or processor is explicitly shown.

DETAILED DESCRIPTION

In the present document, the word "exemplary" is used herein to mean "serving as an example, instance, or illustration." Any embodiment or implementation of the present subject matter described herein as "exemplary" is not necessarily to be construed as preferred or advantageous over other embodiments.

While the disclosure is susceptible to various modifications and alternative forms, specific embodiment thereof has been shown by way of example in the drawings and will be described in detail below. It should be understood, however that it is not intended to limit the disclosure to the particular forms disclosed, but on the contrary, the disclosure is to cover all modifications, equivalents, and alternative falling within the spirit and the scope of the disclosure.

The terms "comprises", "comprising", or any other variations thereof, are intended to cover a non-exclusive inclusion, such that a setup, device or method that comprises a list of components or steps does not include only those components or steps but may include other components or steps not expressly listed or inherent to such setup or device or method. In other words, one or more elements in a system or apparatus proceeded by "comprises . . . a" does not, without more constraints, preclude the existence of other elements or additional elements in the system or method.

The present disclosure relates to a method and apparatus for rotating a card when the card is not displayed correctly to a viewer of the card. The holding apparatus comprises at least two proximity sensors, a control unit and a motor. Each of the at least two proximity sensors are configured to determine orientation of the card when the card is present in the holding apparatus. The control unit is configured to determine status of each of the at least two proximity sensors in order to determine position of the holding apparatus. The status of the at least two proximity sensors is at least one of open and close. The control unit is further configured to transmit a control signal to the motor based on the determined status. The motor rotates the card upon receiving the control signal, thereby orienting the card with respect to the viewer.

In the following detailed description of the embodiments of the disclosure, reference is made to the accompanying drawings that form a part hereof, and in which are shown by way of illustration specific embodiments in which the disclosure may be practiced. These embodiments are described in sufficient detail to enable those skilled in the art to practice the disclosure, and it is to be understood that other embodiments may be utilized and that changes may be made without departing from the scope of the present disclosure. The following description is, therefore, not to be taken in a limiting sense.

FIG. 1 shows a detailed block diagram illustrating a holding apparatus for holding a card in accordance with some embodiments of the present disclosure.

In an implementation, the holding apparatus 101 comprises at least two proximity sensors 103, a control unit 105 and a motor 107.

Figure 3A:
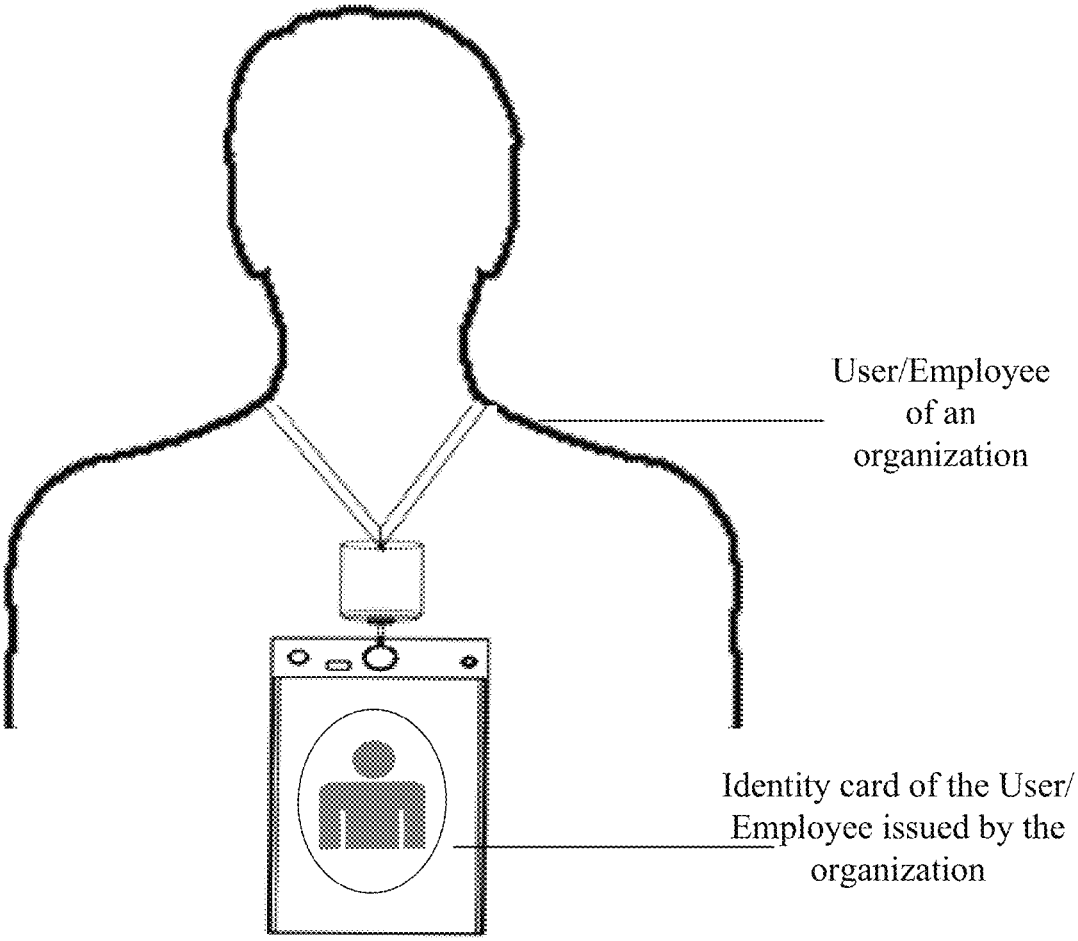
FIGS. 3*a*-3*c* show exemplary orientation of the holding apparatus in accordance with some embodiments of the present disclosure.
Figure 3B:
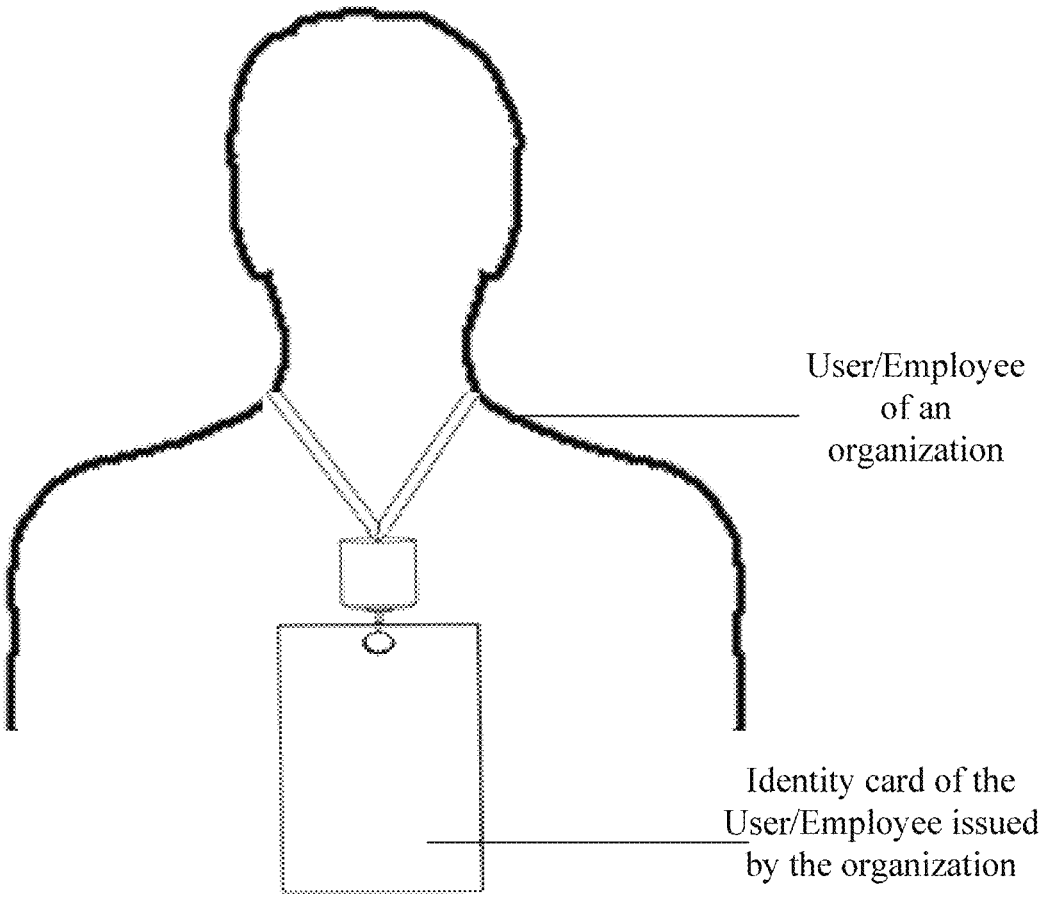
Figure 3C:
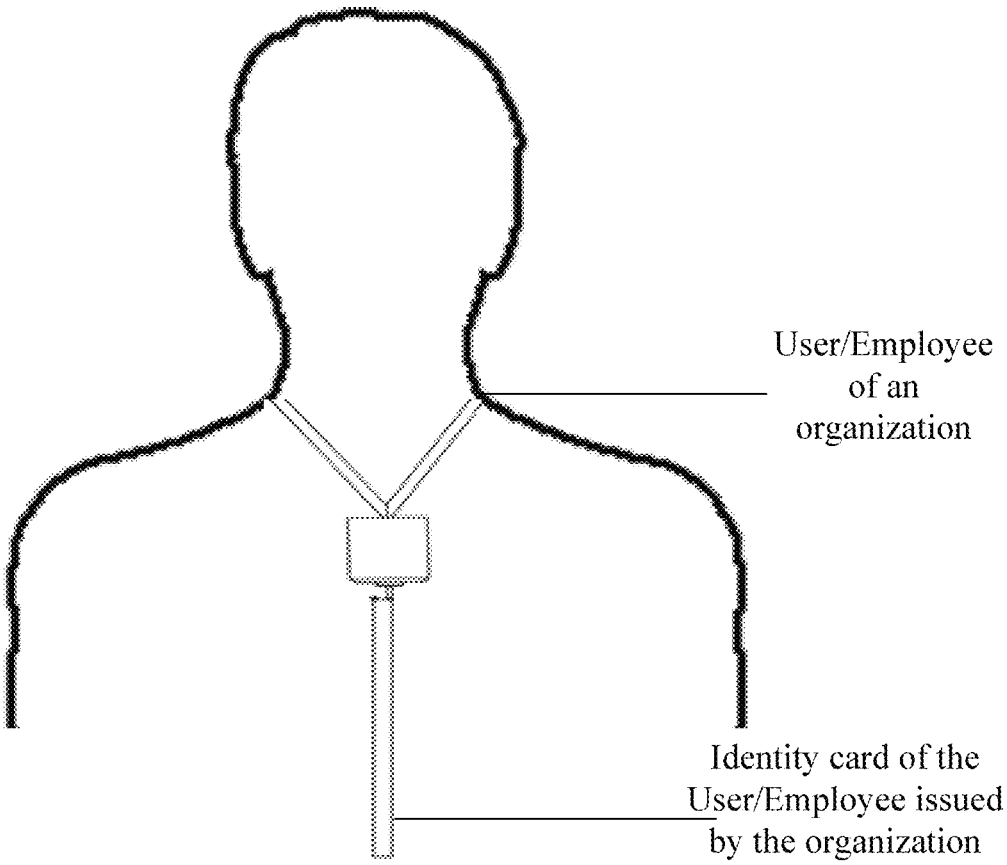

The at least two proximity sensors 103 are configured to determine orientation of the card when the card is present in the holding apparatus 101. In an embodiment, one of the at least two proximity sensors 103 is configured at front side of the holding apparatus 101 and other of the at least two proximity sensors 103 is configured at rear side of the holding apparatus 101. In an embodiment, the position of each of the at least two proximity sensors 103 may not be limited to the position as shown in FIGS. 3*a*-3*c*.

The control unit 105 is configured to determine status of each of the at least two proximity sensors 103 to determine the position of the holding apparatus 101. The control unit 105 further transmits a control signal to the motor 107 based on the status. In an embodiment, the control unit 105 may also receive one or more data, such as activation parameters 127, over a wired or wireless communication interface 121 and store the received data in the memory unit 109. The activation parameters 127 may include, but not limited to, the one or more user defined locations and the corresponding Global Positioning System (GPS) coordinates, speed of rotation of the motor 107, the speed, level and/or intensity of the alert from the User Alert Module 135 and frequency of checks performed on the status of the at least two proximity sensors 103.

The motor 107 is configured to rotate the card upon receiving the control signal from the control unit 105. The control unit 105 transmits the control signal to the motor 107 based on the status of the at least two proximity sensors 103. In an embodiment, the status of the at least two proximity sensors 103 is at least one of open and close. The motor 107 rotates the card when the status of one of the at least two proximity sensors 103 configured at a front side of the holding apparatus 101 is close and the status of other of the at least two proximity sensors 103 configured at a rear side of the holding apparatus 101 is open.

In an implementation, the control unit 105 may include, but not limited to, a receiving module 111, a transmitting module 113, a GPS module 117, a motion detection module 119, a communication interface 121 and other modules 123. In an embodiment, the other modules 123 may be used to perform various miscellaneous functionalities of the control unit 105 in the holding apparatus 101. It will be appreciated that such aforementioned modules may be represented as a single module or a combination of different modules.

In an embodiment, the receiving module 111 is configured to receive one or more signals and data from the one or more modules of the holding apparatus 101. As an example, the receiving module 111 may receive one or more configuration data, such as, the activation parameters 127 from the user of the holding apparatus 101. Further, the receiving module 111 may also receive one or more signals and/or data from the at least two proximity sensors 103, the GPS module 117 and the motion detection module 119, which are in turn passed to the control unit 105.

In an embodiment, the transmitting module 113 may transmit one or more control signals from the control unit 105 to one or more modules of the holding apparatus 101. As an example, the transmitting module 113 may transmit a control signal to the motor 107 for rotating the card when the status of one of the at least two proximity sensors 103 configured at a front side of the holding apparatus 101 is close and the status of other of the at least two proximity sensors 103 configured at a rear side of the holding apparatus 101 is open.

In an embodiment, the at least two proximity sensors 103 in the holding apparatus 101 are activated by one of the one or more predetermined activation modes. The one or more predetermined activation modes include a GPS mode, a motion detection mode and a manual selection mode. Any one of the one or more predetermined activation modes may be used to activate the at least proximity sensors 103, based on the user preference.

In the GPS mode of activation, a GPS/Advanced GPS (AGPS) module 117 activates each of the at least two proximity sensors 103 when current location of the holding apparatus 101 matches with one or more user defined locations. Further, the GPS/AGPS module 117 may keep a track of the current location and co-ordinates of the holding apparatus 101 and compares them with the one or more user defined security checkpoints and/or access control location co-ordinates. The holding apparatus 101 is activated when the current location and coordinates of the holding apparatus 101 matches with the coordinates of the user defined location.

In the motion detection mode of activation, a motion detection module 119 or an accelerometer configured in the holding apparatus 101 activates each of the at least two proximity sensors 103 upon detecting movement of the user of the holding apparatus 101. As an example, the motion detection module 119 activates the holding apparatus 101 when the holding apparatus 101 is worn or carried by the user i.e. when the holding apparatus 101 is in motion.

In the manual selection mode of activation, a selection button 133 is used for manually activating the at least two proximity sensors 103 when required by the user. The working and one or more actions performed by the selection button 133 is explained below in detail.

In an embodiment, the communication interface 121 may include, but not limited to, a wireless communication technique such as Bluetooth, NFC and Wi-Fi. The communication interface 121 configured in the holding apparatus 101 may be used to perform one or more actions, including receiving and transmitting one or more information. In another embodiment, the communication interface 121 may be a wired communication network, such as, Local Area Network (LAN), USB etc.

In one implementation, the holding apparatus 101 may further comprise a memory unit 109, a configuration port 131, a selection button 133, a User Alert Module 135 and a battery 137 as shown in FIG. 1.

In one embodiment, the memory unit 109 may store one or more data including, status information 125, activation parameters 127 and other data 129 in the form of various data structures. Additionally, the aforementioned data can be organized using data models, such as relational or hierarchical data models. The other data 129 may store data, including temporary data and temporary files, generated by modules for performing the various functions of the holding apparatus 101.

In another embodiment, the memory unit 109 may include, without limitation, memory drives, removable disc drives, etc., employing connection protocols such as Serial Advanced Technology Attachment (SATA), Integrated Drive Electronics (IDE), IEEE-1394, Universal Serial Bus (USB), fiber channel, Small Computer Systems Interface (SCSI) and the similar. The memory unit 109 may also store a collection of program or database components, including, without limitation, a User Interface (UI) application and an operating system.

In an embodiment, the status information 125 of the at least two proximity sensors 103 is determined by the control unit 105. The status of the at least two proximity sensors 103 is at least one of open and close. The control unit 105 performs an action and/or transmits a control signal to the motor 107 based on the status of each of the at least two proximity sensors 103 as indicated in Table A below.

TABLE A

| Scenarios | Status of proximity sensor at the front side | Status of proximity sensor at the rear side | Action performed |
|---|---|---|---|
| Scenario 1 | Open | Close | No action |
| Scenario 2 | Close | Open | Transmit control signal to the motor |
| Scenario 3 | Close | Close | Activate User Alert Module |
| Scenario 4 | Open | Open | Activate User Alert Module |

Scenario 1:

No action is performed by the control unit 105 when the status of one of the at least two proximity sensors 103 configured at a front side of the holding apparatus 101 is open and the status of other of the at least two proximity sensors 103 configured at a rear side of the holding apparatus 101 is close. As an example, this scenario may occur when the user wears the holding apparatus 101, having the card, such that the card is displayed properly to a person standing opposite to the user.

Scenario 2:

The control unit 105 transmits a control signal to the motor 107 for rotating the card when the status of one of the at least two proximity sensors 103 configured at a front side of the holding apparatus 101 is close and the status of other of the at least two proximity sensors 103 configured at a rear side of the holding apparatus 101 is open. As an example, this scenario may occur when the holding apparatus 101 worn by the user is not displayed properly to a person standing opposite to the user.

Scenario 3 and Scenario 4:

The control unit 105 activates the User Alert Module 135 for alerting/notifying the user of the holding apparatus 101 when the status of each of the at least two proximity sensors 103 is same. Each of the at least two proximity sensors 103 will be closed when they are covered and the free rotation of the card is obstructed. As an example, each of the proximity sensors 103 will be closed when the user keeps the holding apparatus 101 in his pocket/bag. As an example, each of the at least two proximity sensors 103 will be open when the holding apparatus 101 is placed in an unreadable angle. In both Scenario 3 and 4, the control unit 105 fails to determine the orientation of the holding apparatus 101 and hence activates the User Alert Module 135 for raising an alert/notification to the user.

In an embodiment, the configuration port 131 may be used for configuring the holding apparatus 101 with one or more configuration information, such as, the activation parameters 127. As an example, the activation parameters 127 may include, but not limited to, user selection of one of one or more activation modes, the one or more user defined locations and the corresponding GPS coordinates, speed of rotation of the motor 107, the speed, level and/or intensity of the alert from the User Alert Module 135 and frequency of checks performed on the status of the at least two proximity sensors 103. In another embodiment, the configuration port 131 may be a Universal Serial Bus (USB) port, which may be used for charging the battery 137 of the holding apparatus 101.

In an embodiment, the selection button 133 may be used for manually activating the at least two proximity sensors 103 by pressing the selection button 133. In an embodiment, the selection button 133 may be configured as ON/OFF to respectively activate or deactivate the holding apparatus 101. The manual mode of activating/deactivating through the selection buttons 133 may be typically set as the default mode of activating/deactivating the holding apparatus 101.

In an embodiment, the User Alert Module 135 is used to notify/alert the user of the holding apparatus 101 when the status of each of the at least two proximity sensors 103 is same, as disclosed in Table A. In an embodiment, the intensity of the alarms and/or vibrations used for notifying the user can be set at different levels based on the preference of the user. As an example, the User Alert Module may include a Light Emitting Diode (LED) indicator, vibration motor and/or a speaker for providing a suitable notification to the user.

The battery 137 is used to power the holding apparatus 101. In an embodiment, the battery 137 may be a rechargeable battery, which can be recharged using the configuration port 131 in the holding apparatus 101.

Figure 2A:
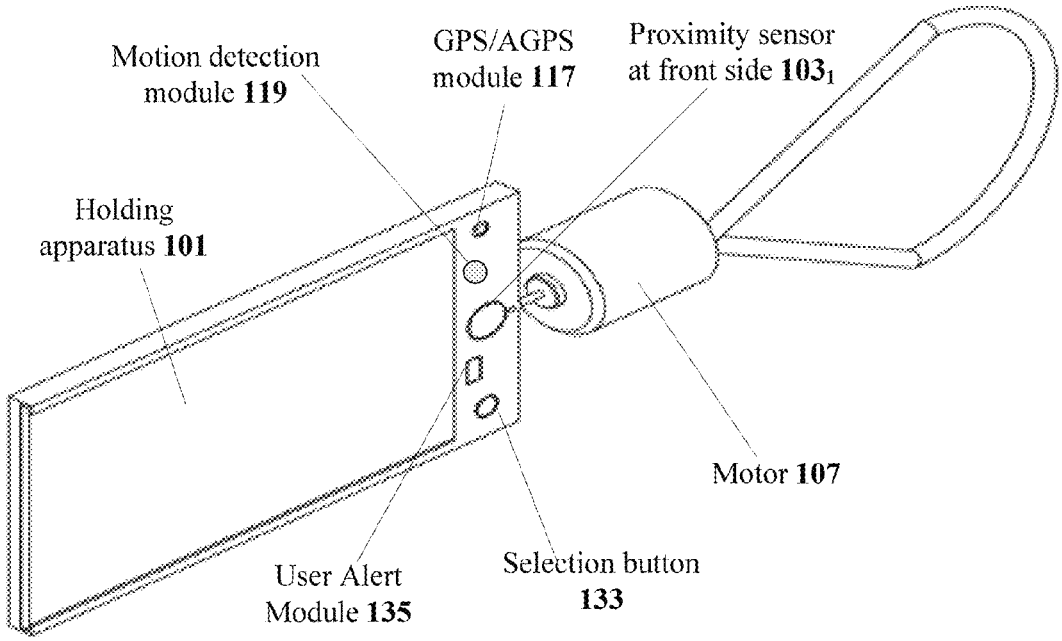
FIGS. 2*a*-2*c* show exemplary representations of the holding apparatus in accordance with some embodiments of the present disclosure.
Figure 2B:
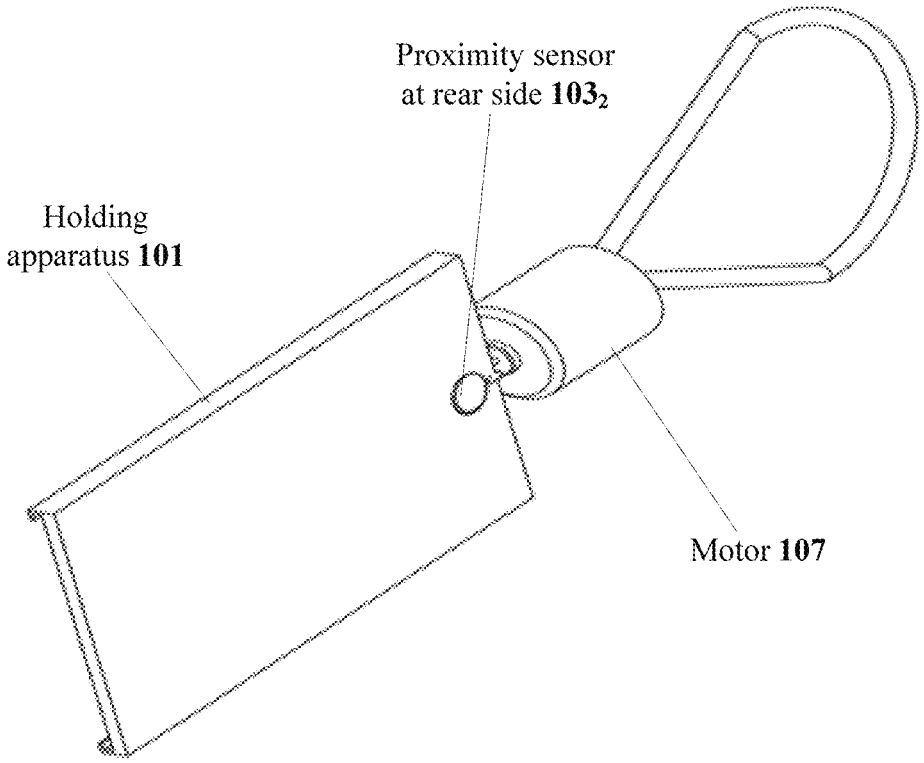

FIG. 2*a* shows a front perspective view of the holding apparatus 101, indicating one of the at least two proximity sensors 1031, which is configured in the front side of the holding apparatus 101. FIG. 2*b* shows the rear perspective view of the holding apparatus 101, indicating the other of the at least two proximity sensors 1032, which is configured in the rear side of the holding apparatus 101.

Figure 2C:
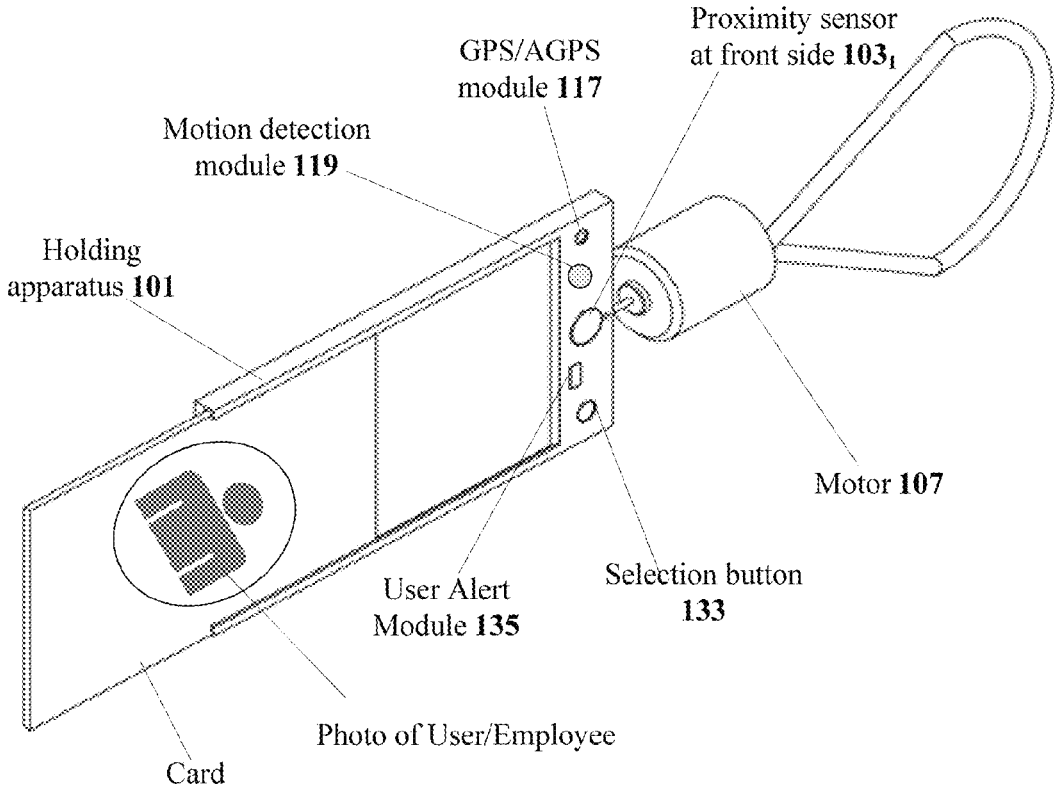

FIG. 2*c* shows a front perspective view of the holding apparatus 101 having a card, such as a user identity card. In an embodiment the holding apparatus 101 comprises at least two proximity sensors 103. Each of the at least two proximity sensors 103, namely, the proximity sensor 1031 configured at the front side of the holding apparatus 101 and the proximity sensor 1032 configured at the rear side of the holding apparatus 101 are activated using one of the one or more activation modes. The one or more activation modes include the GPS/AGPS module 117, the motion detection module 119 (not shown in FIG. 2*c*) and the selection button 133. Upon activation, each of the at least proximity sensors 103 determine the orientation of the card when the card is present in the holding apparatus 101. The control unit 105 (not shown in FIG. 2*c*) configured in the holding apparatus 101 determines the status of each of the at least two proximity sensors 103 in order to determine the position of the holding apparatus 101. Further, the control unit 105 transmits a control signal to the motor 107 based on the determined status. The control unit 105 transmits the control signal to the motor 107 for rotating the card when the status of the proximity sensor 1031 configured at the front side of the holding apparatus 101 is close and the status of the proximity sensor 1032 configured at the rear side of the holding apparatus 101 is open. The motor 107 is configured to rotate the card upon receiving the control signal from the control unit 105. In an embodiment, if the status of each of the at least two proximity sensors 103 is same, the control unit 105 provides a notification to the user of the holding apparatus 101 using the User Alert Module 135 configured in the holding apparatus 101.

FIGS. 3*a*-3*c* show exemplary positions of the holding apparatus in accordance with the various Scenarios provided in Table A. In an embodiment, the FIGS. 3*a*-3*c* show a user of the holding apparatus 101, wearing the holding apparatus 101 with a card present in the holding apparatus 101. As an example, the user may be an employee of an organization. The card present in the holding apparatus 101 may be an identity card issued by the organization for authorizing the user/employee. In an embodiment, the front side of the card may comprise one or more information, such as photo, of the employee of the organization and the rear side of the card may be left blank.

As shown in FIG. 3*a*, the front side of the identity card present in the holding apparatus 101 is displayed correctly to a person standing opposite to the user of the holding apparatus 101. In this scenario, the status of the proximity sensor 1031 configured at the front side of the holding apparatus 101 is open and the status of the proximity sensor 1032 configured at the rear side of the holding apparatus 101 is close. Hence, no action is performed by the control unit 105.

In FIG. 3*b*, the front side of the identity card present in the holding apparatus 101 is not displayed to a person standing opposite to the user of the holding apparatus 101. In this scenario, the status of the proximity sensor 1031 configured at the front side of the holding apparatus 101 is close and the status of the proximity sensor 1032 configured at the rear side of the holding apparatus 101 is open. Hence, the control unit 105 transmits a control signal to the motor 107 in order to rotate the identity card. The motor 107 rotates the identity card upon receiving the control signal from the control unit 105.

In FIG. 3*c*, the front side of the identity card present in the holding apparatus 101 is not displayed properly. In this scenario, the status of the proximity sensor 1031 configured at the front side of the holding apparatus 101 and the status of the proximity sensor 1032 configured at the rear side of the holding apparatus 101 is same. Hence, the control unit 105 provides a notification to the user of the holding apparatus 101 using the User Alert Module 135 configured in the holding apparatus 101.

Figure 4:
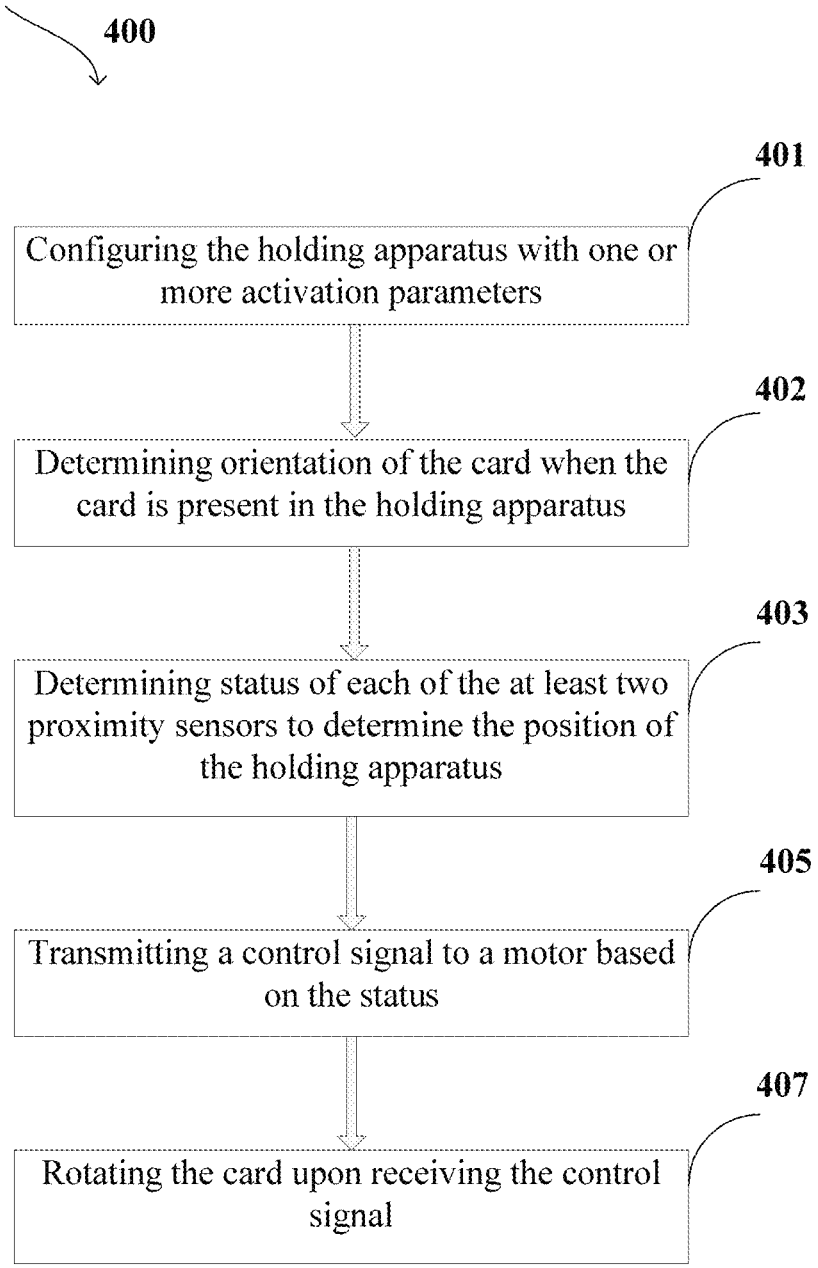
FIG. 4 illustrates a flowchart showing method of rotating a card using a holding apparatus in accordance with some embodiments of the present disclosure.

FIG. 4 illustrates a flowchart showing method for rotating a card using a holding apparatus in accordance with some embodiments of the present disclosure.

As illustrated in FIG. 4, the method 400 comprises one or more blocks for rotating a card using a holding apparatus 101. The method 400 may be described in the general context of computer executable instructions. Generally, computer executable instructions can include routines, programs, objects, components, data structures, procedures, modules, and functions, which perform particular functions or implement particular abstract data types.

The order in which the method 400 is described is not intended to be construed as a limitation, and any number of the described method blocks can be combined in any order to implement the method. Additionally, individual blocks may be deleted from the methods without departing from the spirit and scope of the subject matter described herein. Furthermore, the method can be implemented in any suitable hardware, software, firmware, or combination thereof.

At block 401, the holding apparatus 101 is configured with one or more activation parameters. The one or more activation parameters comprises at least one of user selection of one of one or more activation modes, one or more user defined locations, GPS coordinates of the user defined locations, speed of rotation of the motor, level and intensity of notification and frequency of checks on status of the at least two proximity sensors 103.

At block 402, at least two proximity sensors 103 configured in the holding apparatus 101 determine orientation of the card when the card is present in the holding apparatus 101. In an embodiment, one of the at least two proximity sensors 103 is configured at front side of the holding apparatus 101 and other of the at least two proximity sensors 103 are configured at rear side of the holding apparatus 101 for determining the orientation of the card.

At block 403, a control unit 105 configured in the holding apparatus 101 determines status of each of the at least two proximity sensors 103 to determine the position of the holding apparatus 101. The control unit 105 activates each of the at least two proximity sensors 103 before determining the status of each of the at least two proximity sensors 103. In an embodiment, each of the at least two proximity sensors 103 are activated using one or more predetermined activation modes. In an embodiment, the one or more predetermined activation modes includes a Global Positioning System (GPS) mode, a motion detection mode and a manual selection mode. In an embodiment, the status of the at least two proximity sensors 103 is at least one of open and close.

At block 405, the control unit 105 configured in the holding apparatus 101 transmits a control signal to a motor 107 based on the status of the at least two proximity sensors 103. In an embodiment, the control signal is transmitted to the motor 107 when the status of one of the at least two proximity sensors 103 configured at a front side of the holding apparatus 101 is closed and the status of the other of the at least two proximity sensors 103 configured at a rear side of the holding apparatus 101 is open.

At block 407, the motor 107 configured in the holding apparatus 101 rotates the card present in the holding apparatus 101 upon receiving the control signal. In an embodiment, the control unit 105 provides a notification to the user of the holding apparatus 101 when the motor 107 fails to rotate the card present in the holding apparatus 101.

Advantages of the embodiment of the present disclosure are illustrated herein.

In an embodiment, the present disclosure relates to an apparatus for auto rotating a card when the card is not displayed properly to a viewer of the card.

In an embodiment, the present disclosure eliminates the need for manually rotating the card when the card is not displayed correctly.

In an embodiment, the present disclosure provides a method for automatically rotating the card at one or more user defined locations when the card is not displayed correctly.

In an embodiment, the present disclosure provides a method of notifying the user of the holding apparatus when the card present in the holding apparatus is not displayed correctly.

In an embodiment, the present disclosure provides a user configurable method of activating the proximity sensors in the holding apparatus using at least one of the GPS, the motion detection and the manual selection modes of activation.

The terms "an embodiment", "embodiment", "embodiments", "the embodiment", "the embodiments", "one or more embodiments", "some embodiments", and "one embodiment" mean "one or more (but not all) embodiments of the invention(s)" unless expressly specified otherwise.

The terms "including", "comprising", "having" and variations thereof mean "including but not limited to", unless expressly specified otherwise.

The enumerated listing of items does not imply that any or all of the items are mutually exclusive, unless expressly specified otherwise.

The terms "a", "an" and "the" mean "one or more", unless expressly specified otherwise.

A description of an embodiment with several components in communication with each other does not imply that all such components are required. On the contrary a variety of optional components are described to illustrate the wide variety of possible embodiments of the invention.

When a single device or article is described herein, it will be readily apparent that more than one device/article (whether or not they cooperate) may be used in place of a single device/article. Similarly, where more than one device or article is described herein (whether or not they cooperate), it will be readily apparent that a single device/article may be used in place of the more than one device or article or a different number of devices/articles may be used instead of the shown number of devices or programs. The functionality and/or the features of a device may be alternatively embodied by one or more other devices which are not explicitly described as having such functionality/features. Thus, other embodiments of the invention need not include the device itself.

Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based here on. Accordingly, the embodiments of the present invention are intended to be illustrative, but not limiting, of the scope of the invention, which is set forth in the following claims.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A holding apparatus, comprising:

at least two proximity sensors configured to determine orientation of the holding apparatus when a card is disposed in the holding apparatus;

a control unit configured to:

obtain a status of each of the at least two proximity sensors to determine a position of the holding apparatus; and transmit a control signal to a motor based on the status; and the motor configured to rotate the holding apparatus upon receiving the control signal, whereby the card gets rotated based on the rotation of the holding apparatus.

2. The holding apparatus as claimed in claim 1, wherein the card is an identity card.

3. The holding apparatus as claimed in claim 1, wherein at least one of the at least two proximity sensors is disposed proximate a front side of the holding apparatus and another of the at least two proximity sensors is disposed proximate a rear side of the holding apparatus.

4. The holding apparatus as claimed in claim 1, wherein obtaining the status comprises:

activating each of the at least two proximity sensors using one or more predetermined activation modes; and determining the status of each of the at least two proximity sensors upon activation of each of the at least two proximity sensors.

5. The holding apparatus as claimed in claim 4, wherein the status of the at least two proximity sensors is at least one of open or closed.

6. The holding apparatus as claimed in claim 4, wherein the one or more predetermined activation modes comprises:

a Global Positioning System (GPS) mode, wherein the GPS activates each of the at least two proximity sensors when a current location of the holding apparatus matches one or more user-defined locations;

a motion detection mode, wherein a motion detection sensor activates each of the at least two proximity sensors upon detecting movement of a user of the holding apparatus; or a manual selection mode, wherein a selection button is used for manually activating each of the at least two proximity sensors.

7. The holding apparatus as claimed in claim 1, wherein the control unit transmits a control signal to the motor for rotating the card disposed in the holding apparatus, when the status of one of the at least two proximity sensors disposed proximate a front side of the holding apparatus is closed and the status of another of the at least two proximity sensors disposed proximate a rear side of the holding apparatus is open.

8. The holding apparatus as claimed in claim 1, wherein the control unit provides a notification to a user of the holding apparatus when the status of each of the at least two proximity sensors is the same.

9. The holding apparatus as claimed in claim 1 further comprises a battery configured to provide power for the holding apparatus.

10. The holding apparatus as claimed in claim 1 further comprises a configuration port to configure the holding apparatus with one or more activation parameters.

11. The holding apparatus as claimed in claim 10, wherein the one or more activation parameters comprise at least one of user selection of one of one or more activation modes, one or more user defined locations, GPS coordinates of the user defined locations, speed of rotation of the motor, level and intensity of notification, or frequency of checks on the status of the at least two proximity sensors.

12. A method of rotating a card using a holding apparatus, the method comprising:

determining, by at least two proximity sensors, orientation of the holding apparatus when a card is disposed in the holding apparatus;

obtaining, by a control unit configured in the holding apparatus, a status of each of the at least two proximity sensors to determine a position of the holding apparatus;

transmitting, by the control unit, a control signal to a motor based on the status; and rotating, by the motor configured in the holding apparatus, the holding apparatus upon receiving the control signal, whereby the card gets rotated based on the rotation of the holding apparatus.

13. The method as claimed in claim 12, wherein one of the at least two proximity sensors is disposed proximate a front side of the holding apparatus and another of the at least two proximity sensors is disposed proximate a rear side of the apparatus.

14. The method as claimed in claim 12, wherein obtaining the status comprises:

activating each of the at least two proximity sensors using one or more predetermined activation modes; and determining the status of each of the at least two proximity sensors upon activation of each of the at least two proximity sensors.

15. The method as claimed in claim 13, wherein the status of the at least two proximity sensors is at least one of open or closed.

16. The method as claimed in claim 13, wherein the one or more predetermined activation modes comprises:

activating each of the at least two proximity sensors when a current location of the holding apparatus matches one or more user-defined locations;

activating each of the at least two proximity sensors upon detecting movement of a user of the holding apparatus; or activating each of the at least two proximity sensors manually.

17. The method as claimed in claim 12, wherein a control signal is transmitted to the motor when the status of one of the at least two proximity sensors disposed proximate a front side of the holding apparatus is closed and the status of another of the at least two proximity sensors disposed proximate a rear side of the holding apparatus is open.

18. The method as claimed in claim 12 further comprises providing a notification to a user of the holding apparatus when the status of each of the at least two proximity sensors is the same.

19. The method as claimed in claim 12 further comprises configuring the holding apparatus with one or more activation parameters using a configuration port in the holding apparatus.

20. The method as claimed in claim 19, wherein the one or more activation parameters comprises at least one of user selection of one of one or more activation modes, one or more user defined locations and respective GPS coordinates of the user defined locations, speed of rotation of the motor, level and intensity of notification, or frequency of checks on the status of the at least two proximity sensors.

* * * * *